US005940897A

United States Patent [19]

James

[11] Patent Number: 5,940,897

[45] Date of Patent: Aug. 24, 1999

[54] PLUNGER

[76] Inventor: Anthony L. James, P.O. Box 1462, Gautier, Miss. 39553-1462

[21] Appl. No.: 08/969,422

[22] Filed: Oct. 21, 1997

Related U.S. Application Data

[60] Provisional application No. 60/029,608, Oct. 24, 1996.

[51] Int. Cl.[6] ..... E03D 9/00

[52] U.S. Cl. ..... 4/255.02

[58] Field of Search ..... 4/255.01–255.03

[56] References Cited

U.S. PATENT DOCUMENTS

| | | |
|---|---|---|
| D. 292,631 | 11/1987 | Tash . |
| D. 364,251 | 11/1995 | Novak . |
| 1,684,880 | 9/1928 | Norton . |
| 1,706,315 | 3/1929 | Norton . |
| 3,934,280 | 1/1976 | Tancredi . |
| 4,096,597 | 6/1978 | Duse . |
| 4,186,451 | 2/1980 | Ruo . |
| 5,199,114 | 4/1993 | Christopher . |
| 5,522,094 | 6/1996 | Balazs . |

FOREIGN PATENT DOCUMENTS

| | | |
|---|---|---|
| 250877 | 1/1988 | European Pat. Off. . |
| 468475 | 1/1952 | Italy . |
| 633348 | 12/1949 | United Kingdom . |
| 2236157 | 3/1991 | United Kingdom . |
| WO87/03320 | 6/1987 | WIPO . |

*Primary Examiner*—Charles E. Phillips
*Attorney, Agent, or Firm*—Richard C. Litman

[57] ABSTRACT

A plunger having a handle, an upper cylinder, a lower cylinder, and a nozzle. The bottom portion of the upper cylinder fits over the top portion of the lower cylinder. The handle may be grasped to push the upper cylinder down over the lower cylinder to force compressed air out through the nozzle, or to pull the upper cylinder up to create a vacuum to suck air and/or fluids up. Either compression or vacuum, or both, may be used to unclog drains in sinks, toilets, or other household plumbing fixtures. A disc shaped piston compresses the air inside the lower cylinder when the upper cylinder to which the piston is attached moves down, and creates a partial vacuum when it moves up. The piston is attached by a rod to the handle and the upper cylinder. A spring in the space between the upper and lower cylinders biases the upper cylinder towards a set position with respect to the lower cylinder, and resists movement either upward or downward from the set position. Through the center of the nozzle is an aperture, through which air and fluids may move. The sides of the aperture are formed by an inner ring, which is surrounded by a circular cavity that separates the inner ring from an outer ring. A storage case has an outwardly sloping frustoconical side wall, and a flat circular bottom wall, and covers only the nozzle and the bottom end of the lower cylinder.

4 Claims, 5 Drawing Sheets

Fig. 4
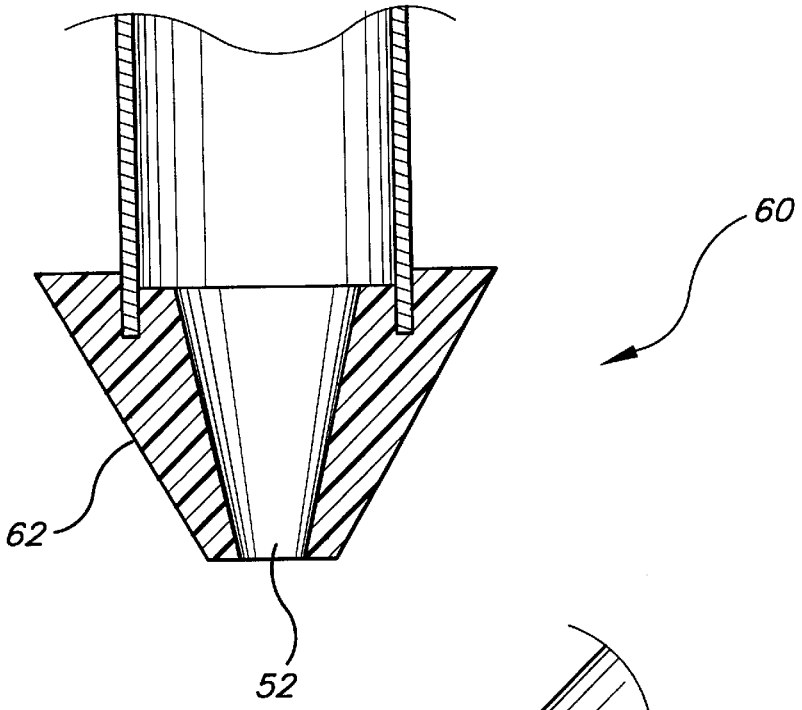
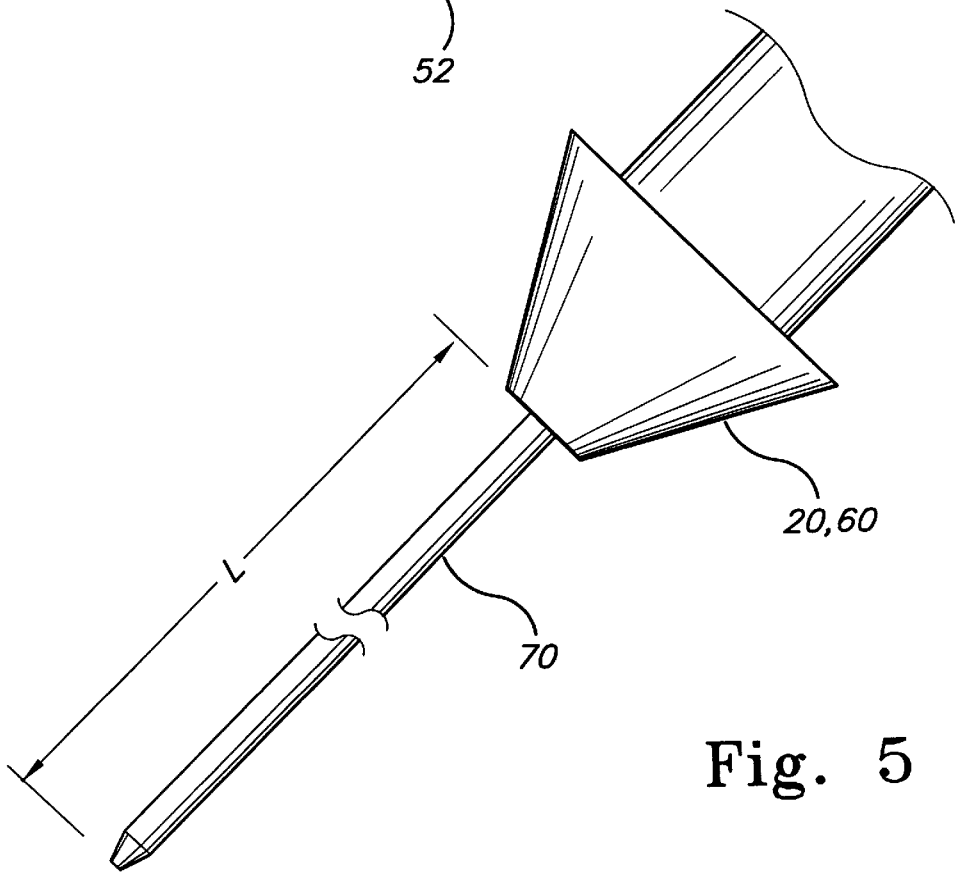
Fig. 5

PLUNGER

CROSS-REFERENCE TO RELATED APPLICATION

This application claims the benefit of U.S. Provisional patent application Ser. No. 60/029,608, filed Oct. 24, 1996.

BACKGROUND OF THE INVENTION

1. Field of the Invention

The present invention relates to a plunger for unclogging drains and pipes.

2. Description of the Prior Art

The present invention is a plunger that utilizes fluid compression to force clogs from drains or pipes. The fluids are selected from the group consisting of air, water, and/or other fluids generally found about the clog. The plunger also removes obstructions by reverse action, thus causing a "vacuum" to draw the clogging material. Although there are numerous prior inventions for plungers, it will be seen that none are equivalent to the present invention.

U.S. Pat. No. 1,684,880, issued on Sep. 18, 1928, and U.S. Pat. No. 1,706,315, issued on Mar. 19, 1929, both to Norton, each discloses a pump having a cylinder, a piston within the cylinder, the piston attached to a first end of a piston rod and moved through the cylinder via a handle at other end of the piston rod. A sealing cup is disposed at the end of the cylinder for enclosing the drain opening so that movement of the piston in the cylinder causes a pressure differential (either positive or negative) at the clog, thus resulting in the movement of the clogging material unstopping the drain.

U.S. Pat. No. 2,697,842, issued on Dec. 28, 1954 to Meyer, discloses a combination hand and air force pressure pump and plunger. This device uses a complex arrangement of valves and conduits for causing a pressure differential at the drain clog.

U.S. Pat. No. 3,934,280, issued on Jan. 27, 1976 to Tancredi, discloses a piston and cylinder drain-flushing device having a restricted aperture through which fluid is expelled forcing a high pressure fluid stream at the source of the clog.

U.S. Pat. No. 4,096,597, issued on Jun. 27, 1978 to Duse, discloses a drain opening device having a fluid filled pair of telescoped cylinders for creating a water jet upon pushing together.

U.S. Pat. No. 4,186,451, issued on Feb. 5, 1980 to Ruo, discloses a plastic sanitary pump including an inverted bowl shaped elastic disc having an inner and outer rim for sealing the pump about a drain opening.

U.S. Pat. No. 5,199,114, issued on Apr. 6, 1993 to Christopher, discloses a drain clearing device having a transparent and hollow cylindrical body, a piston plunger assembly, and a drain seal at the bottom of the cylindrical body formed of closed cell sponge rubber.

U.S. Pat. No. 5,522,094, issued on Jun. 4, 1996 to Balazs, discloses a water plunger for clearing clogged drains having a tapering collar member at its bottom end for seating in a drain opening.

U.S. Pat. Des. Nos. 292,631, issued on Nov. 3, 1987 to Tash, and 364,251, issued on Nov. 14, 1995 to Novak, disclose conventional plunger designs.

British Patent No. 633,348, complete specification accepted on Dec. 12, 1949 to Suarez, discloses a device for cleaning or clearing sinks and the like, with a metal cylinder, a piston like device inside the cylinder moved by a handle outside the cylinder, with a rubber tube on the end of the cylinder opposite the handle.

British Patent No. 2,236,157, published on Mar. 27, 1991 to Houselander, discloses a pump type apparatus for unblocking a waste pipe, having a sealing member in the form of a suction cup for seating about a drain opening.

European Patent No. 250,877, published on Jan. 7, 1988 to Griessner, discloses a pressure actuated drain unblocking device having two resilient bell-shaped members mounted one over another, with a tube through both that is connected to a manually operated air pump.

Italian Patent No. 468,475, published Jan. 22, 1952 to Mascheroni, discloses a pump for clearing drains with a cylinder and a handle driven piston.

W.I.P.O. Patent Document No. 87/03320, published on Jun. 4, 1987 to Girse, discloses a manual device for clearing blocked waste pipes having a hand-pump which is fitted a flexible suction bell and flexible a check-valve for creating a vacuum in the clogged drain.

None of the above inventions and patents, taken either singly or in combination, is seen to describe the instant invention as claimed.

SUMMARY OF THE INVENTION

Drain clogs occur for the most part due to a buildup of particulate, coagulate, and sedimentary in a drain line. Most of these occur in the trap region of the drain line. The present invention is a plunger for unclogging drains. The plunger of this invention incorporates an ordinary pump structure with an improved nozzle for generating an extreme pressure differential at the site of the clog. The pressure differential has an astounding affect on the clogging matter, causing the clog to disintegrate and move, the quick and efficient end result being an unclogged drain.

The present invention provides a handle coupled to one end of a shaft, a piston coupled to the other end of the shaft, the piston being displaceably disposed in a cylinder having a closed end, where the shaft extends through the closed end of the cylinder. A nozzle is used to cap the open end of the cylinder, the nozzle having an aperture of a diameter that is much smaller than the diameter of cylinder. The smaller diameter nozzle produces the stream of fluid used to obliterate a drain clog.

Likewise, when used in reverse, applicant has found that the aperture restricts the entrance of debris into the cylinder. In this fashion, the piston and cylinder are used to extract the clog by producing a "vacuum," which then causes the clog to break up. In the preferred embodiments, the handle is coupled to another cylinder that forms an external telescoping sleeve over the main cylinder. Internally of the sleeve cylinder, a spring member is positioned coaxially with the shaft for biasing the handle with respect to the main cylinder.

The nozzle of the preferred embodiment is formed of a resilient material, such as rubber or polymer. The resiliency allows the nozzle to engage and conform to the opening of the drain in order to establish a fluid tight seal. The fluid tight seal enhances the efficiency of the differential pressure of the plunger. The shape of the nozzle has proven to best facilitate the fluid tight seal. The exterior of the nozzle, in the preferred embodiment, generally has the shape of a pair of frustoconical shells situated end to end. The open end of the main cylinder is firmly seated in the top portion of the nozzle. The bottom portion of the nozzle has a pair of concentric rings of the resilient material. These are defined as the inner and outer rings.

The outer ring is the conformable surface with which the fluid tight seal is made with the drain opening. The inner ring defines the aperture through the center of the nozzle which air and fluids are caused to move. Between the concentric rings, a hollow or nether region is defined. This nether region facilitates the conformability of the outer ring and more importantly, provides a fluid expansion zone. The purpose of the fluid expansion zone allows the standing fluid of the clogged drain to virtually move, upon actuation of the pump of the plunger, reducing the vortex resistance of the fluid stream exiting the nozzle. In this manner the fluid stream from the nozzle, in a laminar flow, is able to penetrate further through the standing fluids and engage the clog with optimum force.

An alternative nozzle is disclosed for simplifying the manufacturing aspects and to accommodate larger size drains. In addition, other embodiments allow the nozzle to extend into long and/or turning drains allowing the instant invention to better improve the drain clearing functions. To add to the aesthetic quality of the instant invention a storage case is provided. This case has a shape conforming to the outward lower slope and the flat circular bottom of the nozzle for supporting the plunger in an upright position when not in use.

Accordingly, it is a principal object of the invention to provide a plunger for clearing clogged drains.

It is another object of the invention to provide a plunger that can force obstructions out of drains and pipes by compressing air and fluids.

It is a further object of the invention to provide a plunger for extracting obstructions from drains and pipes by decompressing air and fluids.

Still another object of the invention is to provide a plunger having a nozzle for producing a laminar fluid stream.

It is yet another object of the invention to provide a plunger utilizing a pressure differential for forcing fluid displacement to unclog drains.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 4 is a cross-sectional view of an alternative nozzle.

FIG. 5 is a broken, elevational view of yet another nozzle.

Similar reference characters denote corresponding features consistently throughout the attached drawings.

DETAILED DESCRIPTION OF THE PREFERRED EMBODIMENTS

Figure 1:
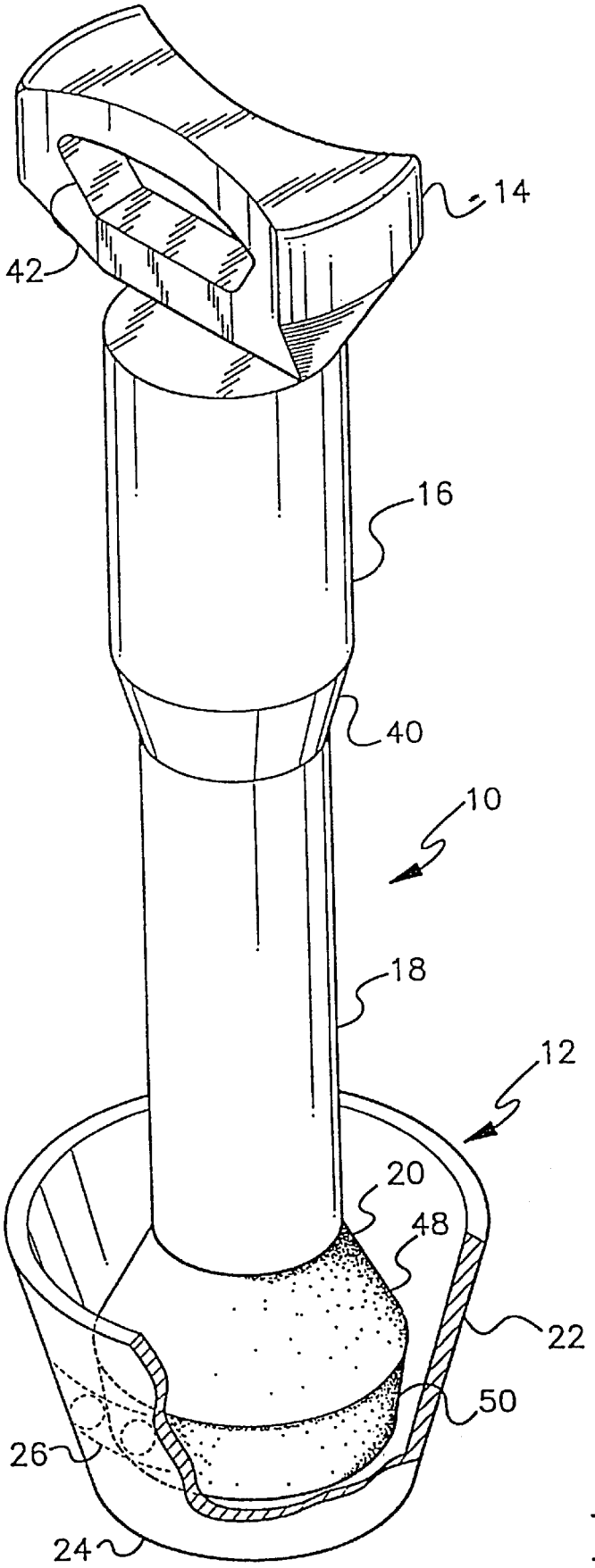
FIG. 1 is a perspective view of the plunger in the storage case.

The present invention is a plunger for unclogging stopped drains described herein with reference to the accompanying drawings. Referring to FIG. 1, the plunger 10 is shown in the storage case 12. The plunger has a handle 14, an upper cylinder 16, a lower cylinder 18, and a nozzle 20, with the part of the nozzle hidden from view by the storage case shown in broken lines. The storage case has an outwardly sloping frustoconical side wall 22, and a flat circular bottom wall 24. Part of the side wall is broken away to better show the nozzle. Decorative patterns 26 on the outer surface of the side wall are indicated in dashed lines.

It can be seen that the storage case 12 covers only the nozzle and the bottom end of the lower cylinder. The purpose of the storage case 12 is mainly to keep the nozzle off the floor, and thus to keep the floor clean from moisture and dirt on the nozzle. The bottom portion of the upper cylinder fits over the top portion of the lower cylinder, and it can be seen that the exterior surface of the upper cylinder has a sloping portion 40 where is meets the exterior surface of the lower cylinder. The handle 14 has a throughbore 42 for easy grasping.

Figure 2:
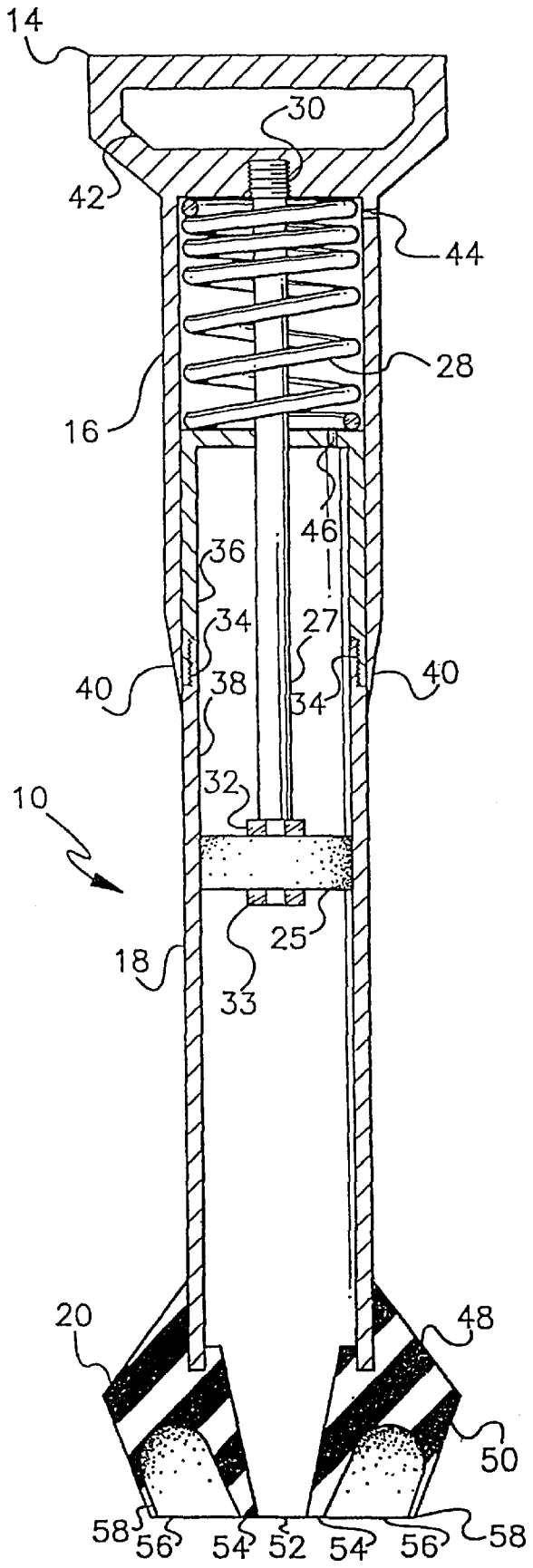
FIG. 2 is a cross-sectional view of the plunger.

As better seen in FIG. 2, the plunger 10 of the present invention utilizes a pump having the basic construction as follows. The plunger 10 has a main cylinder 18 formed of any suitable rigid material. The main cylinder 18 consists of two sections, for ease of manufacturing. An upper section 36 and a lower section 38 fixedly attached via mating thread segment 34. One end of main cylinder 18 is closed having a shaft bore (not shown) and an air vent 46. The main cylinder has a predetermined length and an internal diameter. Disposed within the main cylinder 18 is a piston 25 that has an outer diameter equivalent to the internal diameter of the main cylinder 18. Air port 44 is provided in the side of the sleeve 16. The cooperation of air vent 46 and air port 44 allows the upper volume of main cylinder 18 to remain at ambient atmospheric pressure. This allows the plunger 10 to operate with ease.

The piston 25 has a disk shape with a circumferential surface formed of a material that forms a fluid seal between the piston 25 and the main cylinder 18 while having a low frictional coefficient allowing the piston 25 to slide freely along the internal diameter of the main cylinder 18. The piston 25 travels along most of the predetermined length of the main cylinder 18. The distance traveled by the piston 25 (in either direction) is defined as the stroke of the piston 25. The stroke of the piston 25 is controlled by a shaft 27. Shaft 27 is securely fastened to the piston 25 by fasteners 32, 33 at one end. Fasteners 32, 33 are conventional and well known for mounting a piston to a shaft. Shaft 27 extends from piston 25 through the shaft bore (not shown) in the closed end of main cylinder 18.

The opposite end of shaft 27 is securely affixed to the handle 14 by a threaded coupling 30. The handle 14 is integrally formed with a secondary cylinder or sleeve 16. Sleeve 16 is in sliding and telescoping engagement with the exterior of main cylinder 18. Internally of the sleeve 16 and coaxially disposed about shaft 27 is a bias spring member 28 for maintaining the handle 14 in a neutral position.

At the open end of the main cylinder 18 is the nozzle 20. Nozzle 20 is formed of any suitable resilient and chemical resistant material. Examples of suitable materials are rubbers and polymers. The open end of main cylinder 18 is seated in the nozzle 20 so as to form a fluid tight seal. The shape of nozzle 20 has an outwardly sloping upper part 48, and an inwardly sloping lower part 50. Basically, the exterior shape of the nozzle 20, in the preferred embodiment, is a pair of frustoconical members joined at a common end. Thus the open end of the main cylinder 18 is seated in the top end of the nozzle 20.

Figure 3:
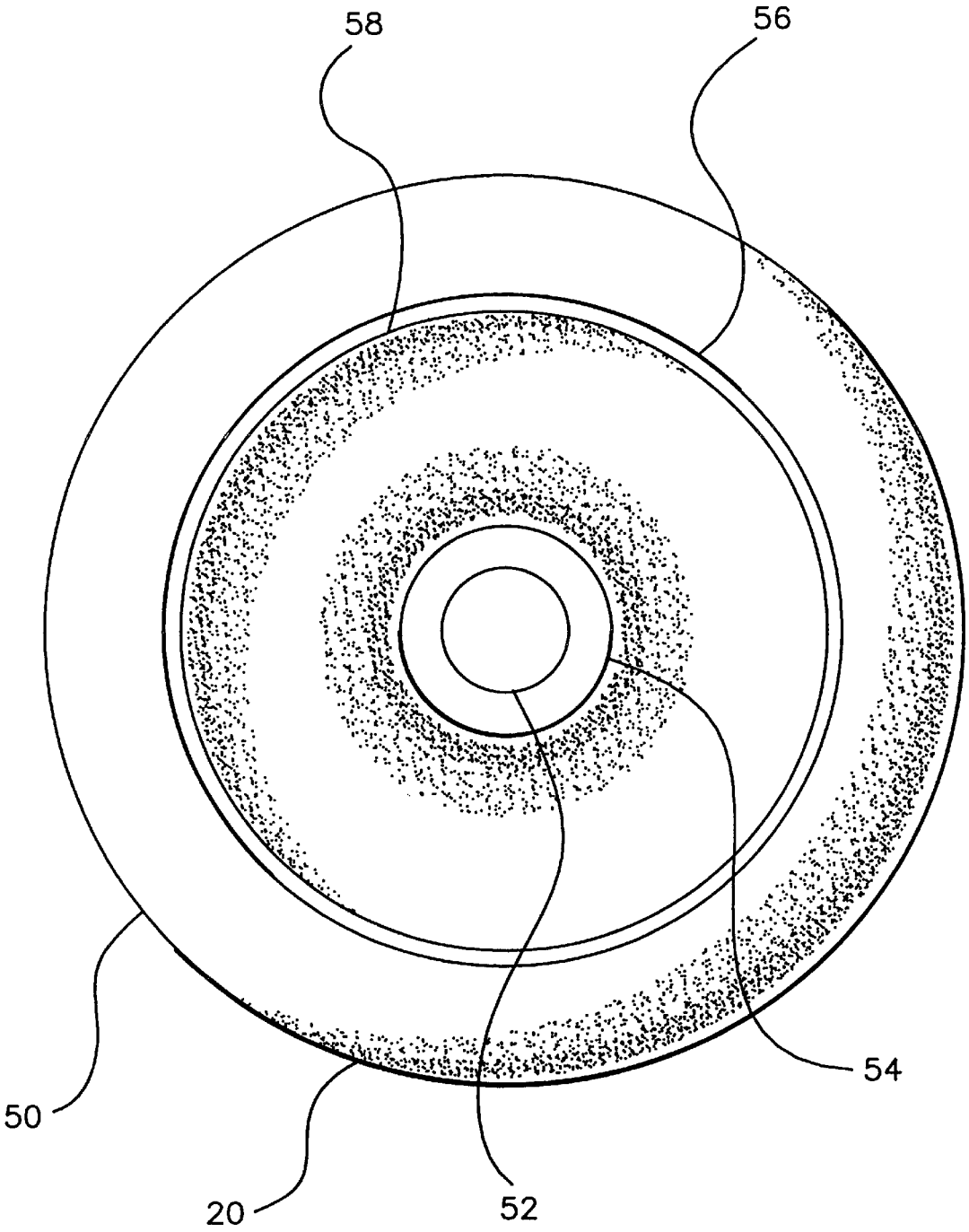
FIG. 3 is a bottom plan view of the nozzle.

The bottom end of nozzle 20 consists of a pair of concentric rings, as seen in FIG. 3 as outer ring 58 and inner ring 54. The inner ring 54 defines aperture 52 through which fluids pass by virtue of the pressure differential of plunger 10. The outer ring 58 is conformable to the drain openings. In this manner, the outer ring 58 assures a fluid tight seal between the nozzle 20 and the drain opening. Between the inner ring 54 and outer ring 58 is a hollow or nether region 56. Nether region 56 allows the outer ring 58 to easily conform to the drain opening. More importantly, nether region 56 provides a fluid expansion zone. The purpose of the fluid expansion zone allows the standing fluid of the clogged drain to virtually move, upon actuation of the pump of the plunger 10, reducing the vortex resistance of the fluid stream exiting the nozzle 20 via aperture 52.

In this manner the fluid stream from the aperture 52, in a laminar (i.e., in a uniformly distributed) flow, is able to penetrate further through the standing fluids and engage the clog with optimum force. In operation, a user removes the plunger from the storage case 12 and withdraws the handle 14 for the full stroke of piston 25. The nozzle 20 is then placed at a clogged drain opening. The outer ring 58 automatically conforms to the size and shape of the drain opening due to the resiliency of the material. The user then thrusts the handle 14, pushing the piston 25, via shaft 27, through the main cylinder 18. The fluid volume in main cylinder 18 ahead of piston 25 is forced through aperture 52 due to the pressure differential established by the thrusts of piston 25. The fluid exit aperture 52 in a laminar flow and in a definite stream, engages the clog, causing the clog to disintegrate.

Alternatively, the nozzle 20 is seated at the drain opening, then the handle 14 is withdrawn. In this fashion, the piston 25 is moved though the full stroke causing a pressure differential allowing the standing fluid of the drain to pass through the aperture 52 into the main cylinder 18. The movement of fluid acts upon the clog, causing the clog to crumble. In either operation, the drain is cleared of the clog and fluids are free to pass through the drain.

Figure 6:
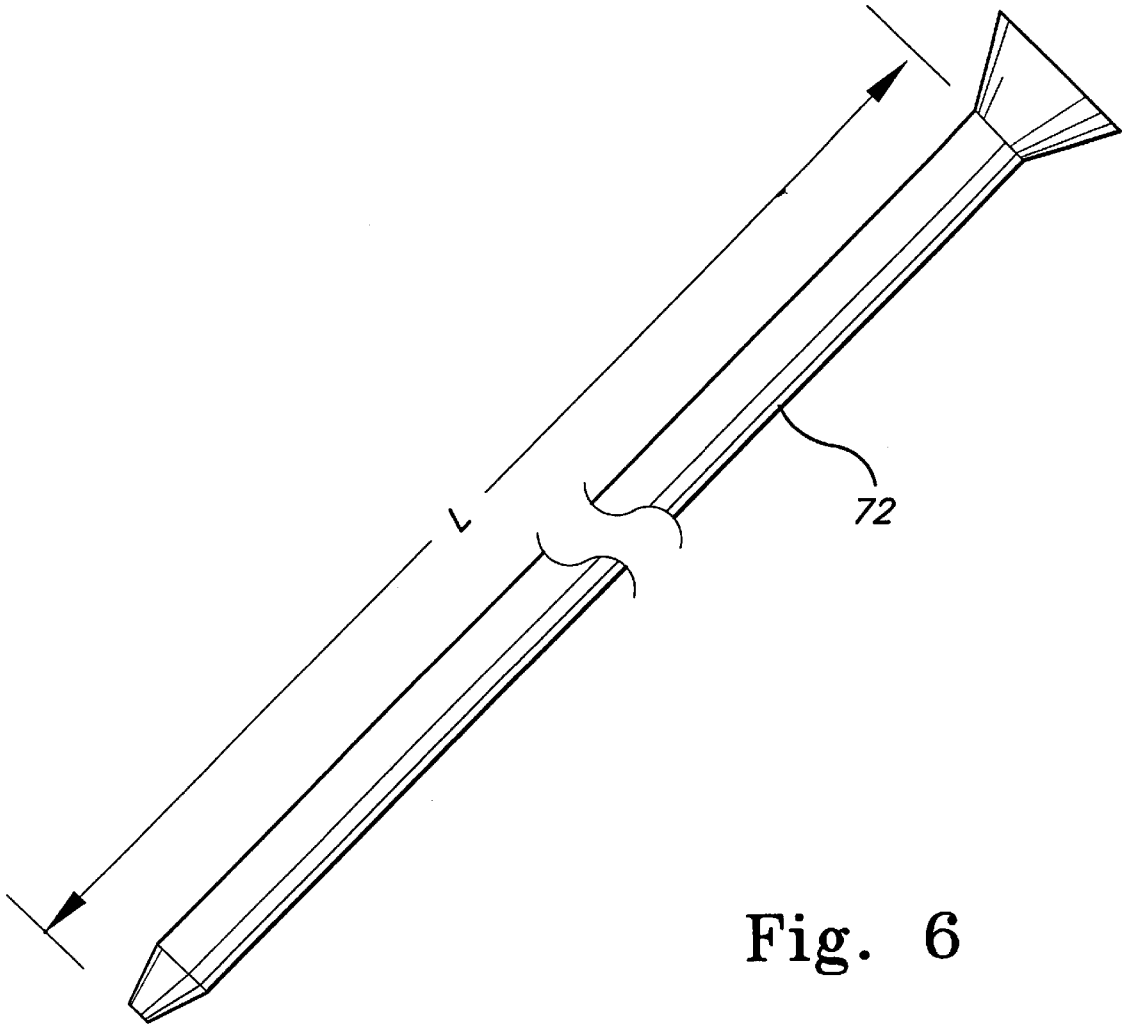
FIG. 6 is a broken, elevational view of an adapter for the nozzle.

FIGS. 4–6 show alternative nozzles for peculiar applications. The nozzle 60 of FIG. 4 has a generic frustoconical shape 62 and an aperture 52 defined therein. Nozzle 60 provides the advantage of accommodating obscure or industrial type drain openings. In this embodiment, the frustoconical shape 62 seats in a drain opening and the plunger is used as set forth above. In certain plumbing designs, the trap (i.e., the location of most clogs) is remote and removed from the accessible drain opening, or by virtue of design, a bend may be in the drain pipe before the trap is positioned. These types of drains present an added problem of applying the fluid stream to the clog from aperture 52.

The nozzle 20 or 60 is modified by providing a semi-rigid extension 70 integrally formed with either nozzle 20, 60. The semi-rigid extension 70 bends for following the drain path, while maintaining the elongated cylindrical shape. The extension 70 is provided in variable lengths L to be chosen upon the specific length required by the drain. The extension 70 has a central bore through which fluid flows from the plunger 10 upon the pressure differential. Thus a fluid stream is presented to the clog from the extension 70, resulting in the clog becoming dislodged. FIG. 5 is representative of multiple nozzles having extensions 70 of varying lengths L. FIG. 6 is representative of an adapter 72 for attachment to the either nozzle 20, 60. The adapter 72 provides greater flexibility and convenience to the user. The adapters 72 of FIG. 6 are equivalent to the extensions 70 of FIG. 5, having varying lengths for specific applications.

It is to be understood that the present invention is not limited to the sole embodiment described above, but encompasses any and all embodiments within the scope of the following claims.

I claim:

1. A device for dislodging drain obstructions comprising:

a cylindrical piston chamber having a closed end and an open end, said closed end having an air vent means and a shaft bore;

a piston displaceably disposed within said cylindrical piston chamber, said piston forming a fluid tight seal about said cylindrical piston chamber separating said cylindrical piston chamber into upper and lower volumes varying with respect to the displacement of said piston;

a shaft having a first end and a second end, said first end of said shaft coupled to said piston, said second end of said shaft extending through said shaft bore of said closed end of said cylindrical piston chamber;

a resilient nozzle member coupled to said open end of said cylindrical piston chamber, said resilient nozzle member providing a fluid tight seal at said opened end of said cylindrical piston chamber; and a handle coupled to said second end of said shaft, said handle including a cylindrical sleeve telescopingly coupled to said cylindrical piston chamber, said cylindrical sleeve forming an outer volume and said cylindrical sleeve having an air vent port; said air vent port cooperating with said air vent of said closed end of said cylindrical piston chamber for maintaining said upper volume at ambient atmospheric pressure;

wherein movement of said handle displaces said piston within said cylindrical piston chamber creating a pressure differential in said lower volume, said pressure differential forcing a fluid displacement through said resilient nozzle member, said fluid displacement moving a drain obstruction.

2. The device according to claim 1, said resilient nozzle member formed of a resilient material, having an aperture defined by a circular portion of said resilient material, said aperture having a diameter much smaller than the diameter of said cylindrical piston chamber; and said resilient nozzle member having a seating ring of said resilient material concentrically disposed about said circular portion of material;

wherein a nether region is defined between said circular portion and said seating ring, said nether region providing stabilization of said resilient nozzle member when placed on a drain and producing a fluid seal about the drain.

3. The device according to claim 1, said handle further including means disposed internally of said cylindrical sleeve for biasing said handle relative to said cylindrical piston chamber.

4. The device according to claim 1, said handle further including means for biasing said handle relative to said cylindrical piston chamber.

* * * * *